US008683616B2

(12) United States Patent
Zielinski

(10) Patent No.: US 8,683,616 B2
(45) Date of Patent: Apr. 1, 2014

(54) SLIMMING GARMENTS

(75) Inventor: Richard Zielinski, Columbus, OH (US)

(73) Assignee: Lane Bryant Purchasing Corp., Columbus, OH (US)

( * ) Notice: Subject to any disclaimer, the term of this patent is extended or adjusted under 35 U.S.C. 154(b) by 230 days.

(21) Appl. No.: 13/323,244

(22) Filed: Dec. 12, 2011

(65) Prior Publication Data

US 2013/0145516 A1 Jun. 13, 2013

(51) Int. Cl.
*A41B 9/14* (2006.01)

(52) U.S. Cl.
USPC ..... 2/76; 2/69

(58) Field of Classification Search
USPC ..... 2/69, 76, 78.3, 79, 219, 220, 221, 227, 2/235, 236, 237
See application file for complete search history.

(56) References Cited

U.S. PATENT DOCUMENTS 4,400,832 A * 8/1983 Kinder ..... 2/406
4,494,546 A * 1/1985 Steiman ..... 450/8
4,523,337 A * 6/1985 Leibowitz ..... 2/237
4,976,653 A * 12/1990 White ..... 450/155
5,143,092 A * 9/1992 Flowers ..... 128/875
6,035,448 A * 3/2000 Thomson ..... 2/227
6,276,175 B1 * 8/2001 Browder, Jr. ..... 66/171
6,543,062 B1 * 4/2003 Amsel et al. ..... 2/227
7,341,500 B2 * 3/2008 Horn et al. ..... 450/95
7,587,768 B2 * 9/2009 Wong ..... 2/236
8,381,314 B2 * 2/2013 Takamoto et al. ..... 2/78.3
2004/0237173 A1 * 12/2004 Villalobos ..... 2/236
2005/0132474 A1 * 6/2005 Amsel et al. ..... 2/227
2009/0049584 A1 * 2/2009 Stones ..... 2/221
2010/0192284 A1 * 8/2010 Simon ..... 2/236
2012/0000007 A1 * 1/2012 Hansen ..... 2/234
2012/0036615 A1 * 2/2012 Bradstreet et al. ..... 2/236
2012/0178344 A1 * 7/2012 D'Anza ..... 450/95
2012/0253256 A1 * 10/2012 Dahlquist ..... 602/67
2013/0007947 A1 * 1/2013 Moore et al. ..... 2/236
2013/0019370 A1 * 1/2013 Dweck et al. ..... 2/67

* cited by examiner

*Primary Examiner* — Khoa Huynh
*Assistant Examiner* — Andrew W Collins
(74) *Attorney, Agent, or Firm* — Drinker Biddle & Reath LLP

(57) ABSTRACT

A slimming outer garment covering at least a portion of a wearer's lower torso having a garment torso portion for covering the wearer's lower torso with an encircling top edge and a transition band having an edge attached to the garment torso portion along the encircling top edge. The transition band has face-to-face interconnected elastic inner and outer members, where the inner member has a generally straight configuration when in an independent unstretched state and the outer member has an upwardly-directed curved contour when in an independent unstretched state.

16 Claims, 5 Drawing Sheets

SLIMMING GARMENTS

FIELD OF THE INVENTION

This invention pertains to garments that help slim a wearer's appearance.

BACKGROUND OF THE INVENTION

Men and women who are abdominous or broad in their gluteus maximus area or just have a plus size figure often wish to appear slimmer without relying upon uncomfortable foundation garments or bodysuit shapewear. They also want to wear fashionable pants garments made of stretch fabrics such as jeans made out of denim blended with elastic fibers without displaying unsightly bulging. And, wearing separate foundation garments is particularly undesirable with stretch fabric garments because the outline of the foundation garments may show through the stretch fabric.

It is desirable to use elastic waistbands in pants to make them more comfortable and forgiving. When such garments are worn by people who are abdominous or have a plus size figure the waistbands tend to roll over at the top and produce or highlight bulging in the wearer's body rather than produce a slimming effect. This waistband roll problem is aggravated when the garments themselves are designed to draw in the wearer's abdomen since doing so tends to push out the body area above the garment. Also, conventional waistbands, such as gathered elastic waistbands and simple flat elastic waistbands, when worn in a snug-fitting manner by men and women who are abdominous or broad in their gluteus maximus area, typically leave an opening or gap in back between the waistband and the wearer's body. This, of course, can be very unflattering, and therefore is particularly undesirable.

A well-known approach to generally slimming a wearer's appearance has been the provision of trousers and other garments having built-in elastic control panels that fit closely against the wearer's abdomen. For example, U.S. Pat. No. 6,035,448 to Thomson teaches pants with right and left internal elastic panels made of Spandex® synthetic elastic fiber and nylon. When these pants are properly sized to be snug-fitting to a wearer's body and the zipper is closed, the control panels are drawn closely against the wearer's abdomen under tension to slim and hold their figure in place.

When such garments with built-in elastic control panels are combined with conventional elastic waistbands and are worn by men and women who are abdominous or broad in their gluteus maximus area or just have a plus size figure, the waistband typically cannot make a smooth transition to the wearer's body profile above the waistband. And, as noted above, the waistband may even roll over the top making the transition to the wearer's body profile above the waistband not only unattractive but also uncomfortable.

There is thus a need for garments that are fashionable and capable of substantially slimming the wearer's appearance. If this could be accomplished in pants and other outer garments worn on the lower abdomen with a new waistband design that helps slim the wearer's appearance while producing a smooth transition between the garment and the wearer's body above the garment and eliminating gaps at the back of the garment, an important contribution to the art would be at hand. And, if this could be accomplished with a waistband/control panel combination which together help slim the wearer's appearance while producing a smooth transition between the garment and the wearer's body above the garment, it would constitute a particularly important contribution.

BRIEF SUMMARY OF THE INVENTION

Embodiments include an outer garment for covering at least a portion of a wearer's lower torso that is properly sized to fit snugly about the wearer's abdomen. The garment has a garment torso portion for covering the lower torso that has an encircling top edge. For example, the garment may be a pair of pants having two leg portions extending downwardly from the torso portion and a central fastening system running from the waist of the garment. The torso and leg portions preferably will be made of a stretch fabric such as denim blended with elastic fibers. The torso portion and/or leg portions may also be made of non-stretch fabric.

The encircling top edge of the garment (before it is donned) may be generally flat and level, or it may be flat and canted so that it is lower at the front of the garment torso portion and higher at the rear of the garment torso portion. A tensioned transition band is attached to the garment torso portion along the encircling top edge.

The tensioned transition band has face-to-face interconnected elastic inner and outer members. The inner member is an elastic web with a generally straight configuration when it is in an independent unstretched state and the outer member is cut from a panel or bolt of stretch fabric preferably corresponding in appearance to the fabric of the rest of the garment. The outer member may comprise two or more adjacent segments to facilitate the cutting of outer member segments from the fabric panel or bolt while minimizing waste. The outer member is cut in an upwardly-directed curved contour so that it has this shape when it is in its independent unstretched state.

Preferably the inner and outer members will be aligned by interconnecting them along their top and bottom edges. This may be accomplished by stitching along the top and bottom edges of the inner and outer members while the outer member is stretched to achieve alignment of the edges of the inner and outer members.

While the assembled tensioned transition band (and hence its interconnected inner and outer members) may be any desired width, it is preferred that the band be from about 0.5 to 3.0 inches in width. Preferably it will be about 1.25 to 2.75 inches in width.

The outer garment may be a pair of pants or shorts, or it may be culottes, cargos, capris, parachutes, leggings, chinos or khakis. It also may be a skirt, an mini-skirt, a tube skirt, a flared skirt, a pencil skirt, a pleated skirt, an A-line skirt.

In embodiments of the invention at least the torso portion of the garment may be made of stretch fabric incorporating an elastic component. For example, the stretch fabric may be stretch denim made of denim blended with elastic fibers such as spandex or elastane.

When the garment is fully assembled with the tensioned transition band attached at the encircling top edge of the garment, the transition band will have a curved contour that dips toward the front of the garment. Preferably the lowest point or dip of the band at the center of the front of the garment will be about 1.0 to 1.5 inches below the level of the band at the back of the garment.

In embodiments, elastic panels may be attached to the inside of the torso portion of the garment. For example, in pants, shorts, or other garments having a fastening system like a zipper or buttons and opposite button holes to draw the garment up against the wearer's body, elastic panels may be attached inside the torso portion of the garment so that the panels extend from opposite sides of the fastening system.

Thus, when the garment is properly sized to fit snugly about the wearer's abdomen and the fastening system is closed, the elastic panels will be tensioned to compress and help slim the wearer's profile while the transition band creates a smooth transition to the wearer's body above the band.

In accordance with embodiments of the invention utilizing elastic panels attached to the inside of the pants torso portion, the elasticity of the transition band and the compression applied by the elastic panels when the garment is closed about a wearer of the designated size of the garment will be balanced to maintain a smooth transition between the transition band and the torso portion of the garment. If the panels apply too much compression relative to the elasticity of the transition band, the wearer's stomach area will be squeezed up producing a "muffin top" appearance. If, on the other hand, the transition band applies too great an elastic force relative to the compression applied by the elastic panels, an undesirable bulge will appear in the wearer's midriff.

BRIEF DESCRIPTION OF THE DRAWINGS

Features of embodiments that are believed to be novel are set forth with particularity in the appended claims. The invention, together with its objects and advantages of the embodiments of the invention may be best understood with reference to the following description, taken in conjunction with the following drawings, in which like reference numerals identify like elements in the figures, and in which:

DETAILED DESCRIPTION OF THE INVENTION

Embodiments of the present invention are illustrated in the context of a pants garment. Other embodiments, however, are intended to be used with any similar garment, such as shorts, skirts or any other garments that can be worn about the lower abdomen and the waist. All such garments may be worn by men or women, as appropriate.

The pants or other garments of the invention may be made of any conventional material, such as cotton, wool, synthetics, and blends of materials. The pants or other garments preferably will be made of fabric blends including elastic fibers, such as denim/elastic fiber blends and other blends known in the art. If desired, the garments may include pleats.

Figure 1:
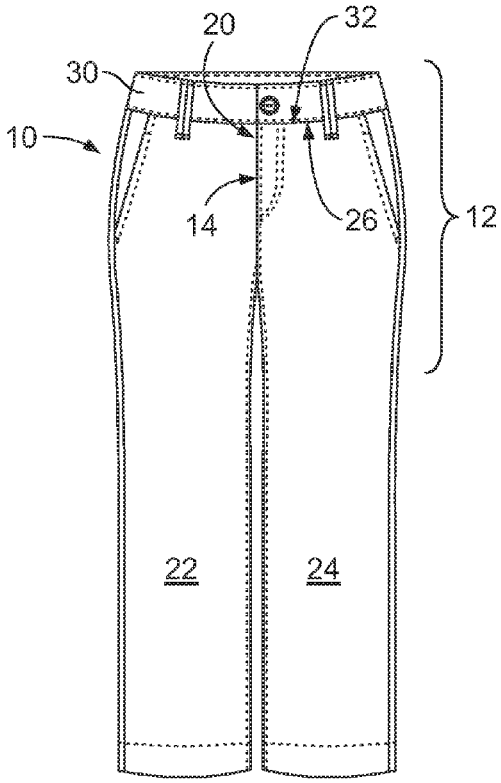
FIG. 1 is a front elevation view of a pants garment in accordance with an embodiment of the invention.
Figure 2:
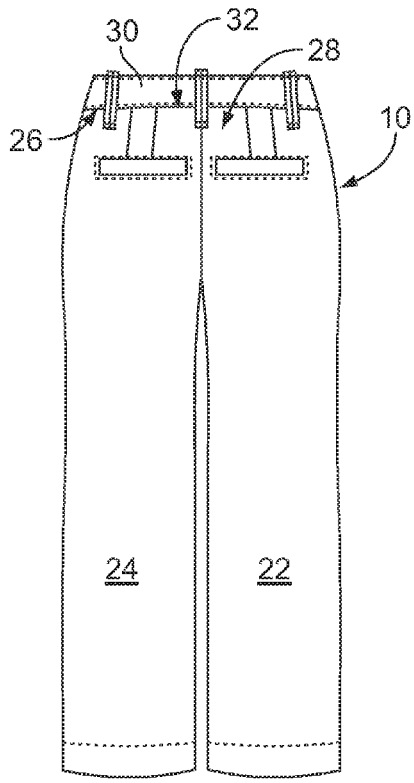
FIG. 2 is a rear elevation view of the pants garment of FIG. 1.
Figure 1A:
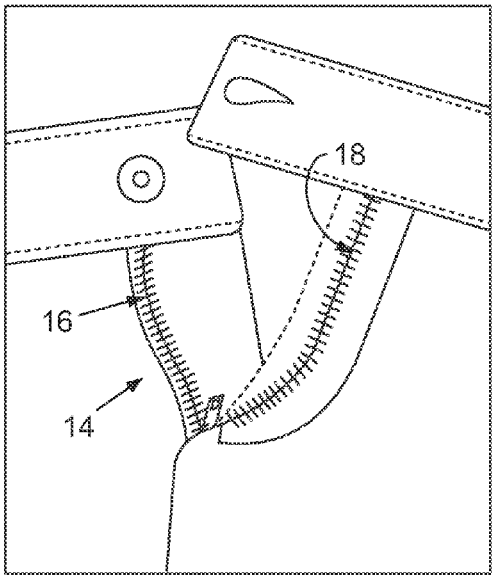
FIG. 1A is an enlarged partial perspective view of a fastening system including zipper portions present in the pants garment of FIG. 1.

Turning to FIGS. 1-2, an outer garment in accordance with an embodiment of the invention is shown in the form of a pants garment 10. The pants garment includes a garment torso portion 12 for covering the wearer's lower torso. The pants garment also includes a fastening system 14 with left and right zipper portions 16 and 18 (FIG. 1A) generally bisecting the front 20 of the pants garment. Pants garment 10 has right and left leg portions 22 and 24 which extend downwardly from the garment torso portion.

The pants garment should be properly sized relative to the figure of a wearer of the designated size of the garment to fit snugly when it is closed on the torso of the wearer. Thus, the garment will be donned with the fastening system open as in FIG. 1A and, once in place on the wearer's body, the fastening system will be closed in order to draw the pants closed so that the torso portion (and, when present, elastic panels 60 and 62 which are referenced below) fit against the wearer's body under tension.

Figure 2A:
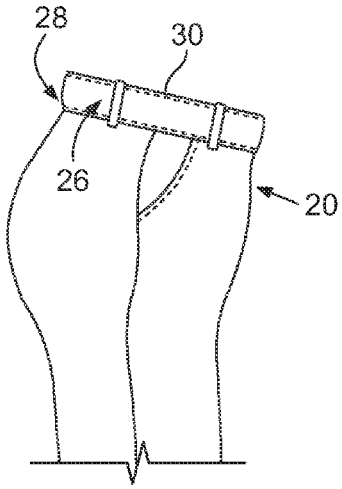
FIG. 2A is a partial side elevation view of a pants garment embodiment in which the top edge of the torso portion of the garment and its waistband are canted.

Torso portion 12 includes a top edge 26 which encircles the torso portion. Preferably, top edge 26 will be canted so that it is lower at the front 20 of the pants and higher at the rear 28 of the pants as shown in exaggerated form in the partial view of FIG. 2A.

Figure 3A:
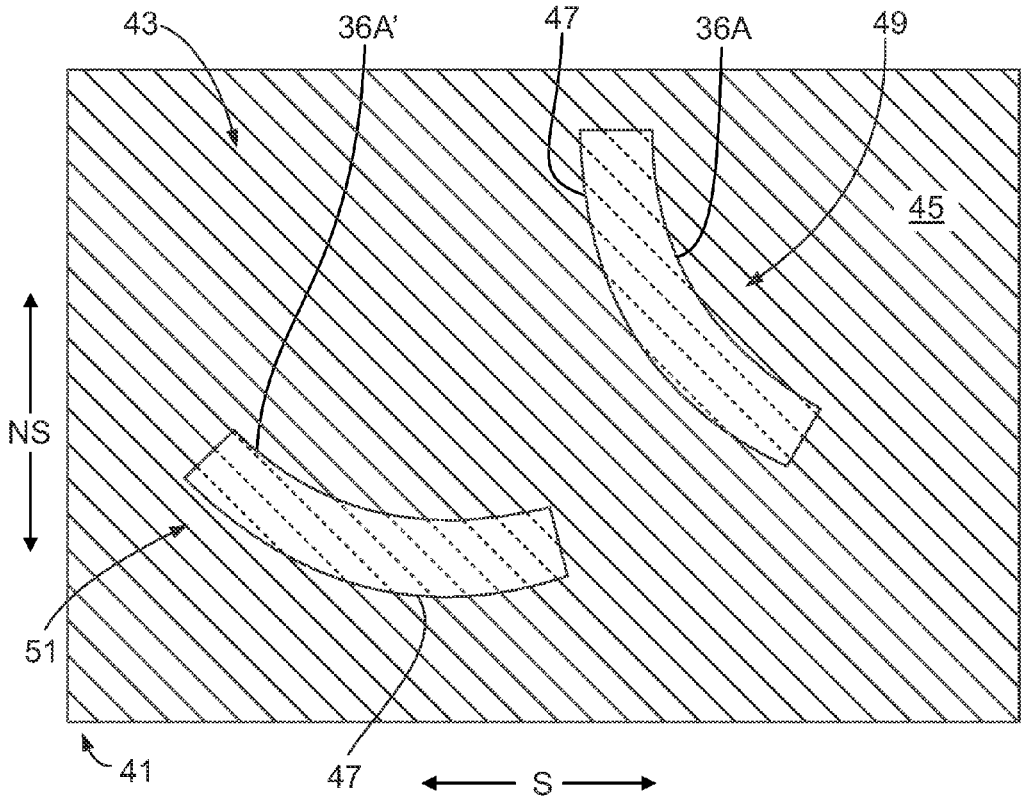
FIG. 3A is a representation of the back of a panel of twill weave stretch fabric from which outer members of a tensioned transition band for the pants garment of FIG. 1 may be cut.
Figure 3B:
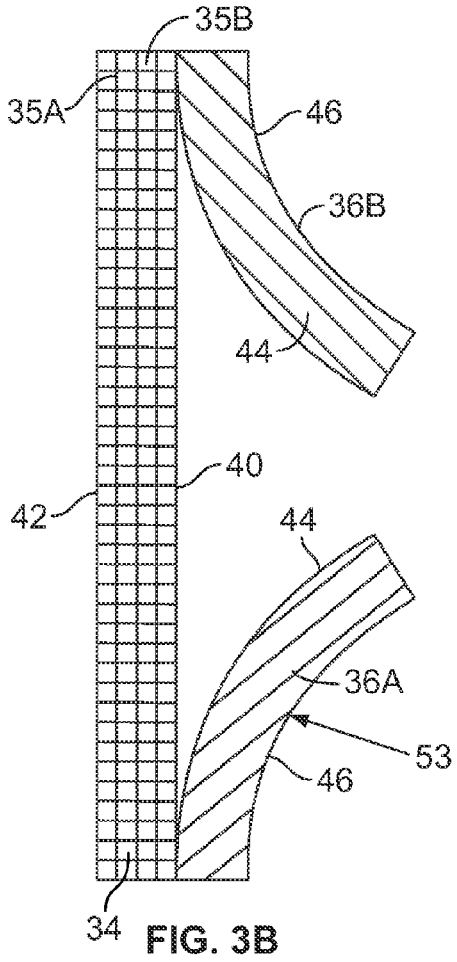
FIG. 3B is a diagrammatic representation of the inner and outer members of a tensioned transition band in accordance with embodiments before the inner and outer members are interconnected.
Figure 3C:
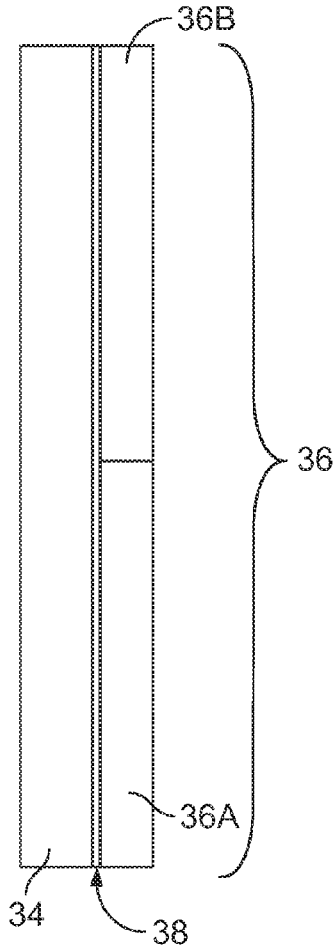
FIG. 3C is a diagrammatic representation of a tensioned transition band in which the inner and outer members are interconnected and the band is under tension to maintain it in a linear configuration before attachment to the encircling top edge of the torso portion of the pants garment.

Pants garment 10 includes a tensioned transition band 30 having an edge 32 along which it is attached to encircling top edge 26 of the garment torso portion. The tensioned transition band is constructed from an inner member 34 and an outer member 36, as best seen in FIG. 3B. As shown in this Figure, the outer member is constructed of two segments, 36A and 36B, although it may comprise a single segment or be constructed of more than two segments. The inner and outer members are interconnected in the fully assembled pants garment with the members in a face-to-face disposition, as shown in FIG. 3C.

Inner member 34 may be a web of elastic having a generally straight configuration when in an independent unstretched state, as, for example, before it is assembled into the tensioned transition band. This straight configuration is illustrated in FIG. 3B, where the disposition of the elastic fibers 35A and 35B of the band are generally parallel and perpendicular to the band's longitudinal axis.

The outer member is cut from a panel of stretch fabric 41 which preferably is a twill weave in which a stable fiber like cotton is blended with a stretch fiber. This is illustrated in FIG. 3A. Preferably, about 1% to 5% by weight of the fabric will be stretch fiber and more preferably about 2% to 3% by weight of the fabric will be stretch fiber. The twill weave of panel 41 is oriented so that it will stretch primarily in direction "S" and will have little or no stretch in the "NS" direction.

The twill weave of panel 41 produces a diagonal weave appearance 43 on the back side 45 of the panel. This diagonal weave appearance can be used to guide the placement of a pattern shape 47 for cutting outer member 36 from the stretch fabric. Thus preferably, the outer member segments will be cut generally in alignment with diagonal weave as at 49 and thus on a 45° bias to stretch direction S. Alternatively, the outer member will be cut parallel to stretch direction S as at 51. In yet other alternatives, the outer member may be cut at orientations between a 45° bias to direction S and parallel to direction S. However, the outer member may not be cut parallel or near parallel to direction NS since this would impair the performance of the transition band.

Most importantly, the outer member will have a curved contour after it is cut and at rest in an independent unstretched state before it is assembled into the tensioned transition band. This contour is referred to as "upwardly directed" since the transition band, which in part takes on the contour of the outer member, is to be oriented in the garment with the inner edge 53 of the curved contour opening upwardly or away from the lower positions of the garment.

Transition band 30 may also include a nonwoven interlining 38 positioned between the inner and outer members to add stability while the inner and outer members are attached. The nonwoven interlining may be fused to the outer member using conventional heating techniques.

Figure 3D:
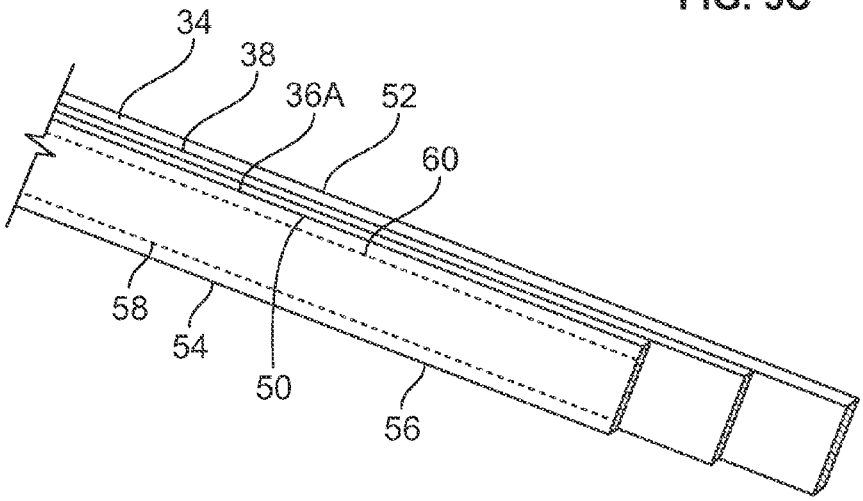
FIG. 3D is a partial perspective view of a tensioned transition band embodiment in which the width of the inner and outer members as well as an internal non-woven lining located therebetween are exaggerated to highlight the structure of the band.

Inner member 34 has inner and outer faces 40 and 42 and outer member 36 (preferably comprised of adjacent segments) has inner and outer faces 44 and 46. The inner and outer members are assembled into the tensioned transition band by positioning inner face 40 of the inner member opposite inner face 44 of the outer member preferably with nonwoven interlining 38 therebetween as shown in FIG. 3C. The inner and outer members are then interconnected adjacent their respective top and bottom edges 50/52 and 54/56 preferably with generally straight lines of stitching 58 and 60 applied just under the outer edges as shown in FIG. 3D.

Interconnecting the respective straight and curved inner and outer members applies a tensioning that produces radially inward as well as upward elastic forces. As a result, the band draws radially inwardly and upwardly to achieve a smooth transition against the wearer's body above the band when the snugly fitting garment is closed on the wearer.

Figure 4:
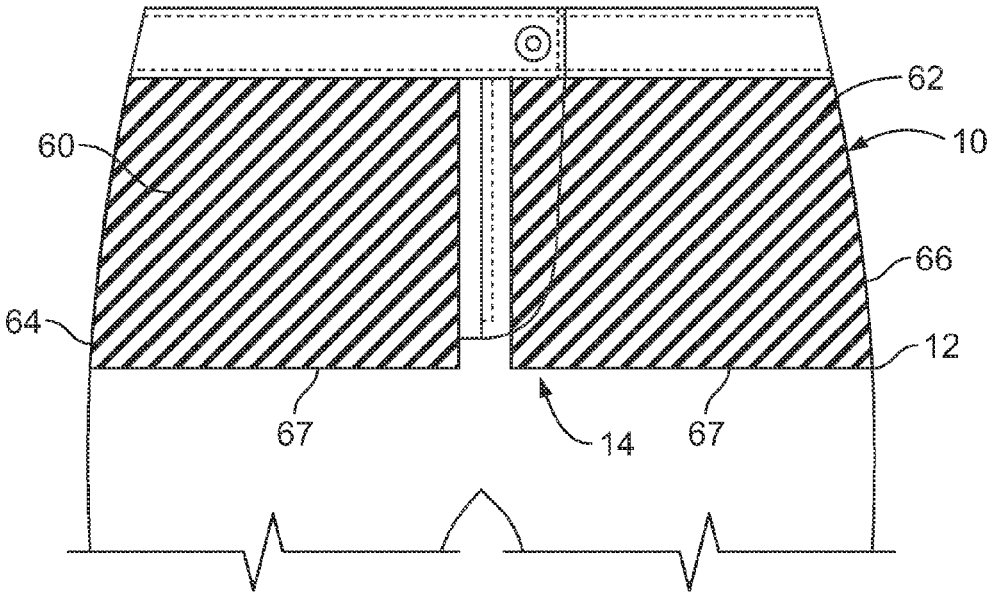
FIG. 4 is a partial elevation view of the torso portion a pants garment embodiment in which elastic panels are shown attached to the inside of the torso portion at opposite sides of the pants garment fastening system.

Turning now to FIG. 4, pants garment 10 may be provided with a pair of elastic panels 60 and 62 attached to the inside of the pants torso portion 12 at opposite sides of fastening system 14. These panels may be made, for example, from about 78% nylon and 22% Spandex®, and have a weight of about 260 grams per square yard. The elastic panels preferably will also be attached along side seams 64 and 66 of the garment torso portion and adjacent the encircling top edge of the garment torso portion. The bottom edges 67 of the elastic panels preferably will be unattached, so that they can hang down freely.

Figure 5:
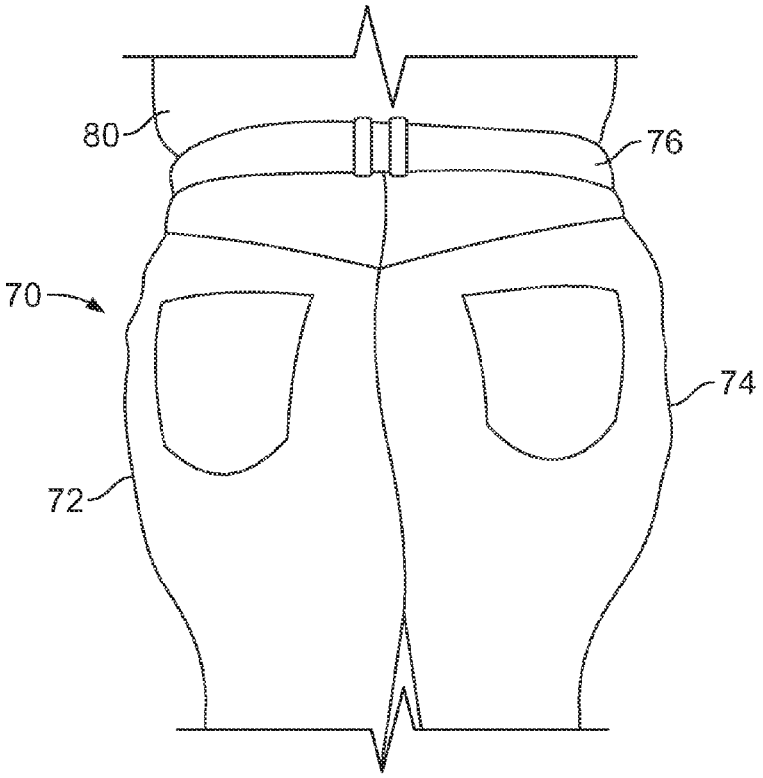
FIG. 5 (PRIOR ART)
FIG. 5 is perspective view of a prior art pants garment worn by a plus size person in a tight-fitting manner.
Figure 6:
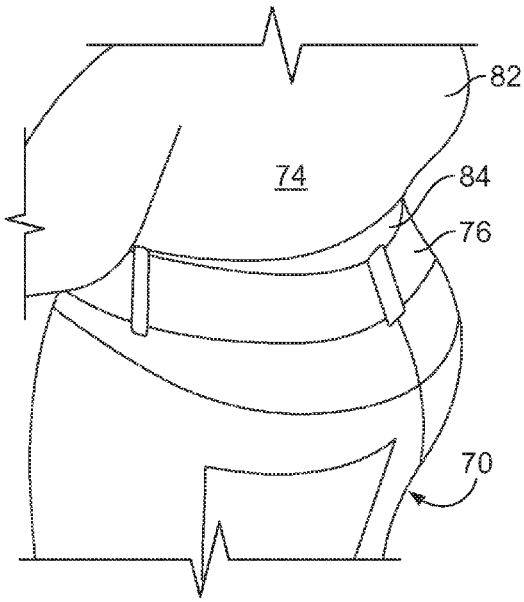
FIG. 6 (PRIOR ART)
FIG. 6 is another perspective view, taken from the rear of the wearer, showing a prior art pants garment worn in tight-fitting manner in which a gap is produced between the waistband of the garment and the wearer's body.

A prior art pants garment 70 is shown in FIG. 5 worn by a plus size person in a snug-fitting manner. As can be seen in this figure, the pants edges 72 and 74 are irregular and waistband 76 cuts into the wearer's abdomen 80 above the band to produce an uneven and unsightly transition which is also likely uncomfortable. FIG. 6 is another view of pants garment 70 on this wearer. As can be seen in this view, waistband 76 stands away from the wearer's back 82 producing a gap 84. This is an unflattering situation which should be avoided if possible.

Figure 7:
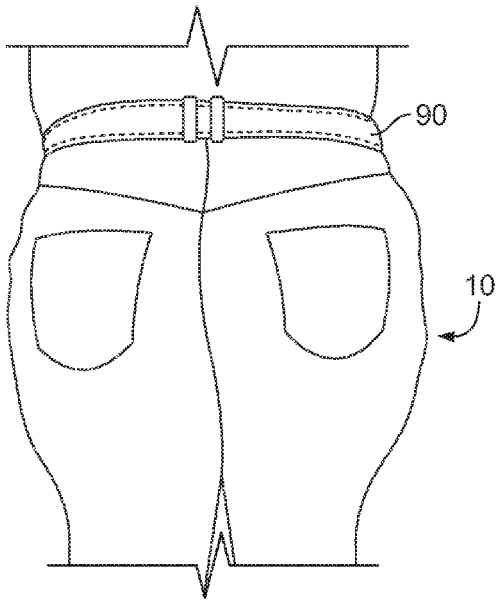
FIGS. 7, 8 and 9 are respectively partial rear elevation, partial front elevation, and partial side elevation views of a pants garment embodiment in which irregular body shaping shown in FIGS. 4 and 5 is minimized or eliminated and the waistband provides a smooth transition to the wearer's body above the waistband without a noticeable "muffin top" or midriff bulge.
Figure 8:
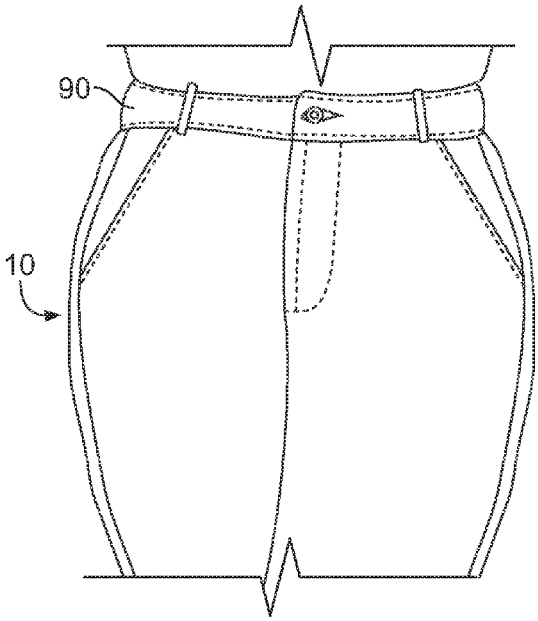
Figure 9:
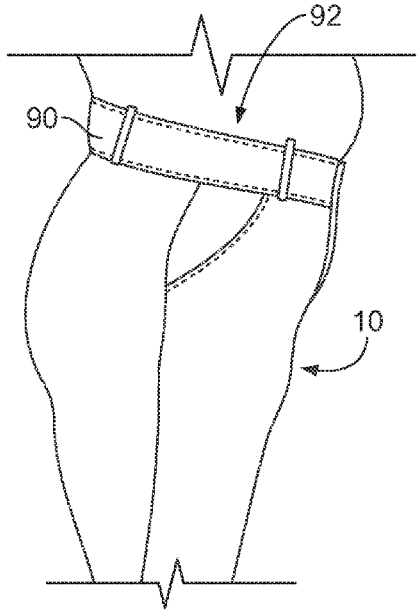

FIGS. 7, 8 and 9 show pants garment 10 in accordance with the present teaching worn in a like manner to that of FIGS. 5 and 6. Here, the irregular shape of the pants garment shown in FIG. 5 is minimized or eliminated and the transition band 90 follows the contour of the wearer's body including at curved contour 92 which accommodates the shape of the wearer's body above the transition band. Gap 84 of the prior art pants of FIG. 6 is nearly or entirely eliminated and a smooth transition is established between the top of band 90 and the wearer's body.

The use of the terms "a" and "an" and "the" and similar referents in the context of describing the embodiments of the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments are described herein. It should be understood that the illustrated embodiments are exemplary only, and should not be taken as limiting the scope of the invention.

What is claimed is:

1. An outer garment covering at least a portion of a wearer's lower torso comprising:

a garment torso portion for fitting to the wearer's lower torso having an encircling top edge; and an elastic transition band having an edge attached to the garment torso portion along the encircling top edge tensioned to draw radially inwardly and upwardly from the encircling top edge and achieve a smooth transition against a wearer's body, the tensioned elastic transition band having face-to-face interconnected elastic inner and outer members, the elastic inner member having a generally straight configuration when in an independent unstretched state, and the elastic outer member having an upwardly-directed curved contour when in an independent unstretched state.

2. The garment of claim 1 in which the garment is chosen from the group consisting of pants, shorts, culottes, cargos, capris, parachutes, leggings, chinos, khakis, skirts, miniskirts, tube skirts, flared skirts, pencil skirts, pleated skirts, and A-line skirts.

3. The garment of claim 2 in which at least the torso portion of the garment is made of a stretch fabric incorporating an elastic component.

4. The garment of claim 1 in which the stretch fabric is stretch denim.

5. The garment of claim 1 in which the encircling top edge is generally flat.

6. The garment of claim 1 in which the encircling top edge is lower at the front of the garment torso portion and higher at the rear of the garment torso portion.

7. The garment of claim 1 in which the tensioned transition band has an upwardly directed curved contour.

8. The garment of claim 7 in which the transition band is arranged along the encircling top edge of the garment torso portion so that the lowest point along the contour is at or near the front center of the garment.

9. The garment of claim 8 in which the lowest point of the contour at or near the front center of the garment is about 1 to 1.5 inches below the level of the band at the back of the garment.

10. The garment of claim 1 in which the inner and outer members are interconnected along their top and bottom edges.

11. The garment of claim 1 in which the transition band is from 0.5 to 3.0 inches wide.

12. The garment of claim 1 in which the transition band is from 1.25 to 2.75 inches wide.

13. The garment of claim 1 in which the garment is a pair of pants and includes two leg portions extending from the torso portion and a central fastening system.

14. The garment of claim 13 including elastic panels attached to the inside of the pants torso portion extending from opposite sides of the fastening system.

15. An outer garment covering at least a portion of a wearer's lower torso comprising:

a garment torso portion made of a stretch fabric for fitting to the wearer's lower torso having an encircling top edge, the torso portion including a fastening system for closing the garment about a wearer's torso;

an elastic transition band having an edge attached to the garment torso portion along the encircling top edge tensioned to draw radially inwardly and upwardly from the encircling top edge and achieve a smooth transition against a wearer's body, the tensioned elastic transition band having face-to-face interconnected elastic inner and outer members, the elastic inner member having a generally straight configuration when in an independent unstretched state, the elastic outer member having an upwardly-directed curved contour when in an independent unstretched state; and elastic panels attached to the inside of the garment on opposite sides of the fastening system.

16. The garment of claim 15 in which the tensioned transition band has an upwardly directed curved contour.

* * * * *